US008651538B2

(12) United States Patent
Sendin Martin

(10) Patent No.: US 8,651,538 B2
(45) Date of Patent: Feb. 18, 2014

(54) LOCK COMPRISING A LOCKABLE KNOB

(75) Inventor: Ricardo Sendin Martin, Elgoibar (ES)

(73) Assignee: Ojmar, S.A., Elgoibar (Gispuzkoa) (ES)

( * ) Notice: Subject to any disclaimer, the term of this patent is extended or adjusted under 35 U.S.C. 154(b) by 372 days.

(21) Appl. No.: 13/140,925

(22) PCT Filed: May 19, 2009

(86) PCT No.: PCT/ES2009/000269

§ 371 (c)(1),
(2), (4) Date: Jun. 20, 2011

(87) PCT Pub. No.: WO2010/072853

PCT Pub. Date: Jul. 1, 2010

(65) Prior Publication Data

US 2011/0248519 A1 Oct. 13, 2011

(30) Foreign Application Priority Data

Dec. 23, 2008 (ES) ..... 200900016

(51) Int. Cl.
*E05B 3/00* (2006.01)
*E05C 3/06* (2006.01)

(52) U.S. Cl.
USPC . 292/336.3; 292/195; 292/198; 292/DIG. 38; 70/125; 70/127

(58) Field of Classification Search
USPC ..... 292/57, 58, 63, 64, 195, 198, 202, 292/336.3, DIG. 38; 70/125–128, 202, 203, 70/211, 212, 360
See application file for complete search history.

(56) References Cited

U.S. PATENT DOCUMENTS 4,186,952 A * 2/1980 Glass ..... 292/202
4,435,966 A * 3/1984 Craig ..... 70/161
4,878,367 A * 11/1989 Bisbing ..... 70/491
4,910,982 A * 3/1990 Dana ..... 70/370

(Continued)

FOREIGN PATENT DOCUMENTS

DE 202005020043 2/2006
DE 202005020043 U1 2/2006

(Continued)

OTHER PUBLICATIONS

International Search Report dated Aug. 1, 2011 for PCT/ES2009/000269.

*Primary Examiner* — Carlos Lugo
(74) *Attorney, Agent, or Firm* — Lucas & Mercanti, LLP

(57) ABSTRACT

The invention relates to a lock comprising a lockable knob, formed by a closure tongue (1) non-rotatably mounted on the shaft of a cylinder (2) which rotates in a casing (3) under the action of a knob (4). The knob (4) is mounted on the cylinder (2) and casing (3) such that it can move linearly between two end positions, namely an operating position and a locked position. The casing (3) and the knob (4) include at least two geometrically arranged linear guides (33, 43) which, during the linear movement of the knob (4), are engaged with, or released from one another. In addition, the cylinder (2) and the knob (4) include radial openings (20, 40) which are positioned coaxially in the locked position and offset axially in the operating position. The cylinder (2) and the casing (3) include geometrically arranged cams (22, 32) which limit the rotational movement of the cylinder (2) in the casing (3) between the tongue (1) -opening and -closing positions.

2 Claims, 5 Drawing Sheets

(56) References Cited

U.S. PATENT DOCUMENTS

| | | | | | |
|---|---|---|---|---|---|
| 4,995,652 | A * | 2/1991 | Mugnolo et al. | 292/202 | |
| 5,152,161 | A * | 10/1992 | Lee | 70/127 | |
| 5,413,392 | A * | 5/1995 | Schlack et al. | 292/204 | |
| 5,634,359 | A * | 6/1997 | Huebschen | 70/379 R | |
| 6,296,286 | B2 * | 10/2001 | Glaser et al. | 292/198 | |
| 6,443,505 | B1 * | 9/2002 | Linares et al. | 292/195 | |
| 6,546,765 | B1 * | 4/2003 | Linares | 70/210 | |
| 6,568,226 | B1 * | 5/2003 | Ramsauer | 70/127 | |
| 6,748,776 | B2 * | 6/2004 | Bullock et al. | 70/212 | |
| 7,350,382 | B2 * | 4/2008 | Hoffmann | 70/139 | |
| 2011/0309637 | A1 * | 12/2011 | Beck | 292/57 | |

FOREIGN PATENT DOCUMENTS

| | | | | |
|---|---|---|---|---|
| EP | 1411198 | | 4/2004 | |
| EP | 1411198 | A1 | 4/2004 | |
| EP | 2017112 | A1 * | 1/2009 | B60K 15/05 |
| ES | 2-290-840 | | 2/2008 | |
| ES | 2290840 | T3 | 2/2008 | |
| FR | 2-864-133 | | 6/2005 | |
| FR | 2864133 | A1 | 6/2005 | |
| GB | 2-105-400 | | 3/1983 | |
| GB | 2105400 | A | 3/1983 | |

* cited by examiner

LOCK COMPRISING A LOCKABLE KNOB

This is a 371 of PCT/ES2009/000269 filed May 19, 2009 which in turn claimed the priority of Spanish Patent Application No. P200900016 filed Dec. 23, 2008, both applications are incorporated by reference herein.

The present invention refers to a lock comprising a lockable knob, such as the type used in keyless lockers.

In the current state of the art, keyless locks that open/close an enclosure or locker by simple turning action of the knob are already known.

In locks with this type of operation, to prevent them from going from the opening position to the closing position or vice versa, and to maintain the lock in locked positions, it is necessary to lock the rotation with respect to the casing, of at least one of the two main parts (knob or cylinder). In known locks, this locking is generally achieved by locking the knob in the casing and unlocking is achieved by simply releasing the lock to allow the knob to turn, and with it the cylinder (the knob and the cylinder do not move in relation to each other).

With the lock that is the object of the invention, the knob is mounted on the casing and can be moved linearly, guided between two end positions of operation and locking for which the casing and the knob have at least two geometrically arranged linear guides which, in the linear movement of the knob with respect to the casing, are engaged with or are released from each other. The locking is achieved by locking the knob guide lodged in the casing guide—or vice versa- and the unlocking is achieved by simple linear movement of the knob until both guides are released from each other.

With the lock that is the object of the invention, the knob is mounted on the cylinder and can be moved linearly, guided between two end locked and unlocked positions for which:

a) The cylinder has a slotted axial orifice and the knob has a pin shaft guided on it—or vice versa, and
b) The knob and the cylinder each have radial orifices, one in the knob and the other in the cylinder.

The locked position is obtained by fixing the knob and cylinder with respect to each other in the position in which said radial orifices are coaxial and the unlocked position is obtaining by linearly moving the knob with respect to the cylinder to axially offset said radial orifices.

The advantages of this new lock, according to the invention, are obvious because its structure is simplified and a minimum number of components are used: only a knob, cylinder, casing, (as well as the closure tongue itself connected to the cylinder and a commercial lock).

Therefore, the suggested lock comprises a new invention that involves inventive activity, and can be applied industrially.

To better understand the object of the present invention, a preferential form of practical embodiment is represented in the diagrams, subject to accessory changes that do not alter its basic principle.

Figure 1:
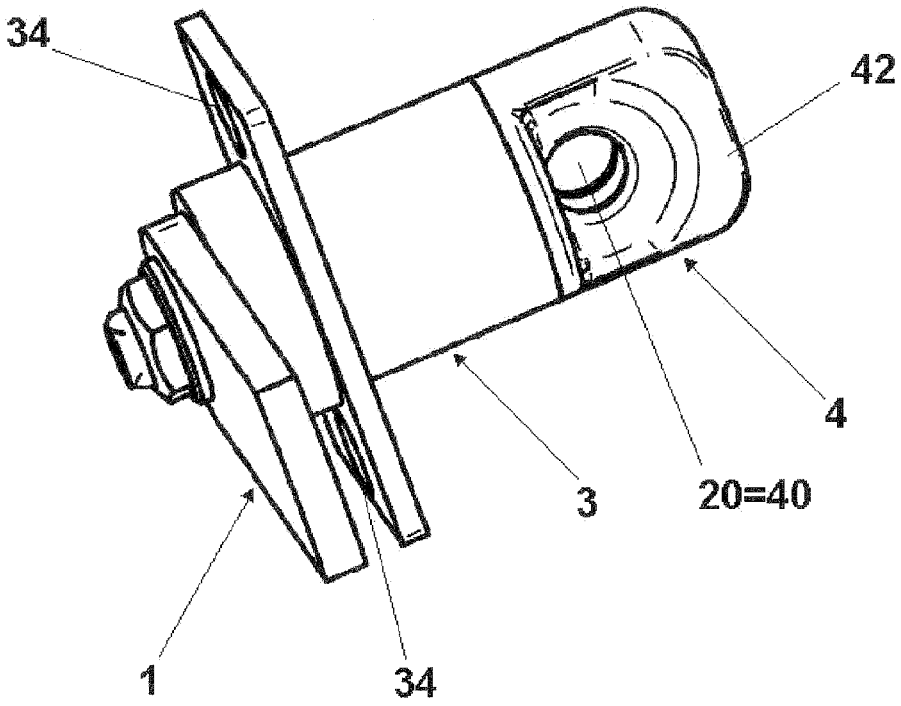
FIG. 1 represents a general schematic perspective view of the lock that is the object of the invention, with its components in closed and locked position.
Figure 2:
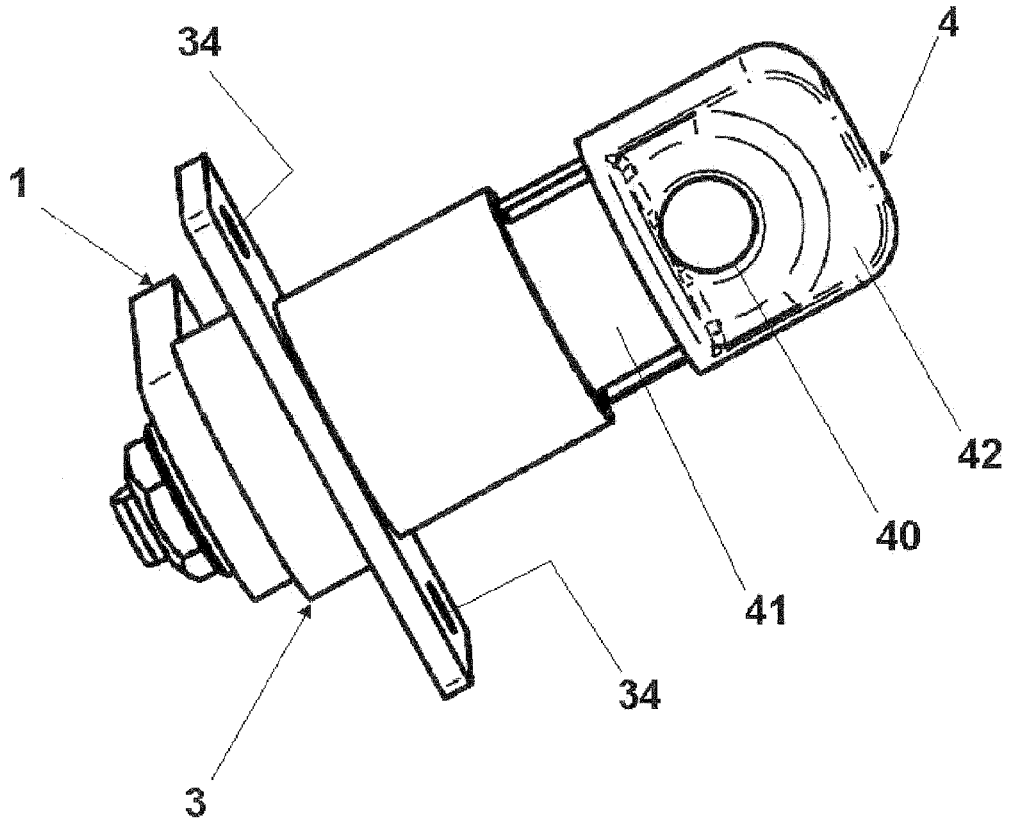
FIG. 2 represents a general schematic perspective view, similar to the foregoing figure, with its components in opening and unlocked position.
Figure 3:
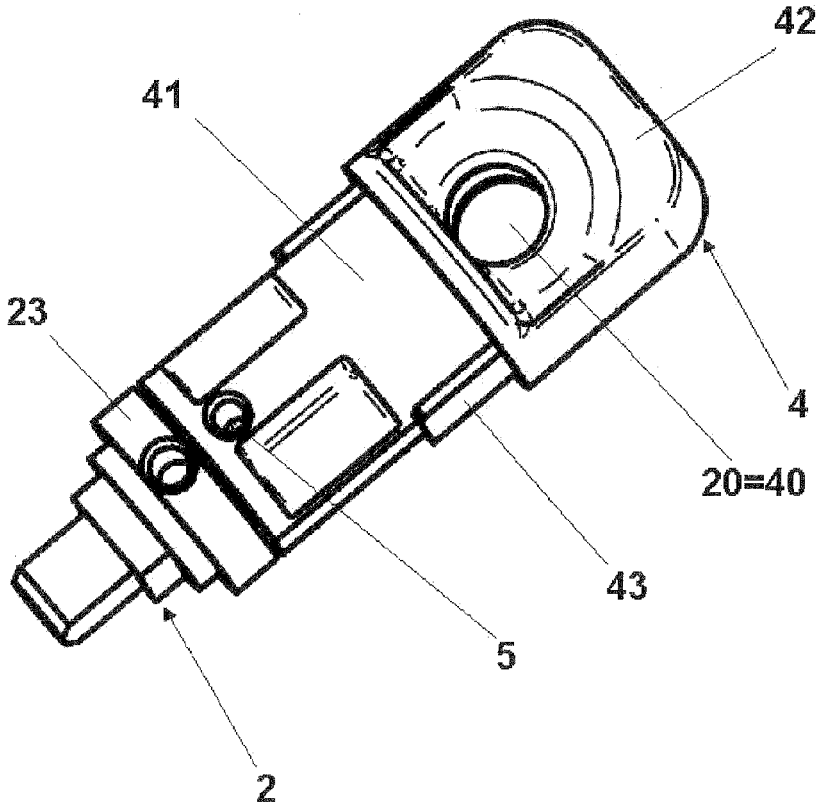
FIG. 3 represents a general schematic perspective view similar to FIG. 1 but without the casing (3) or the closure tongue (1).
Figure 4:
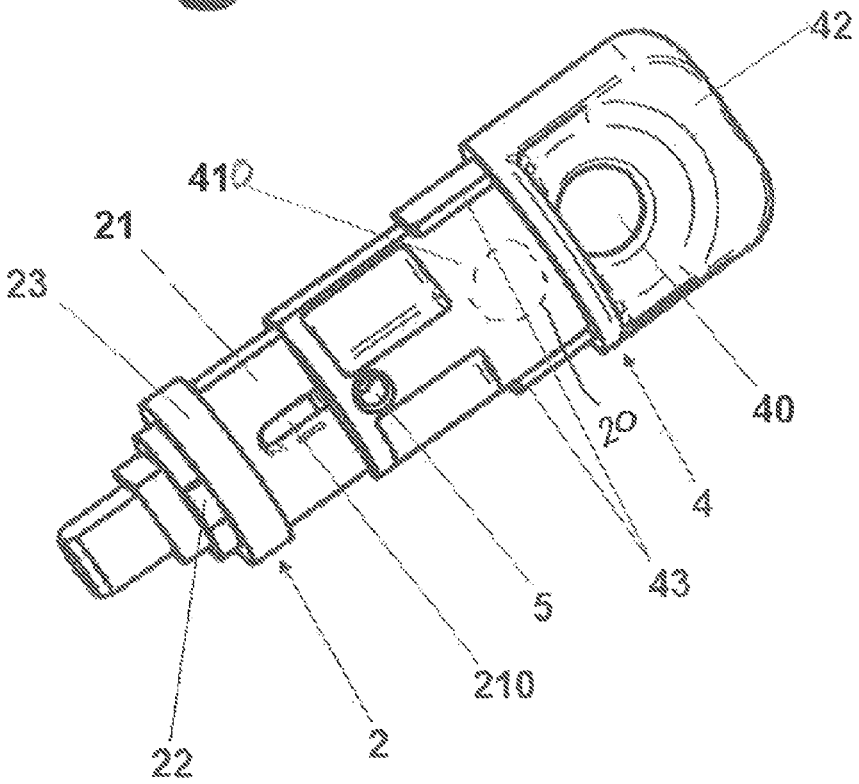
FIG. 4 represents a general schematic perspective view similar to FIG. 2 but without the casing (3) or the closure tongue (1).
Figure 5:
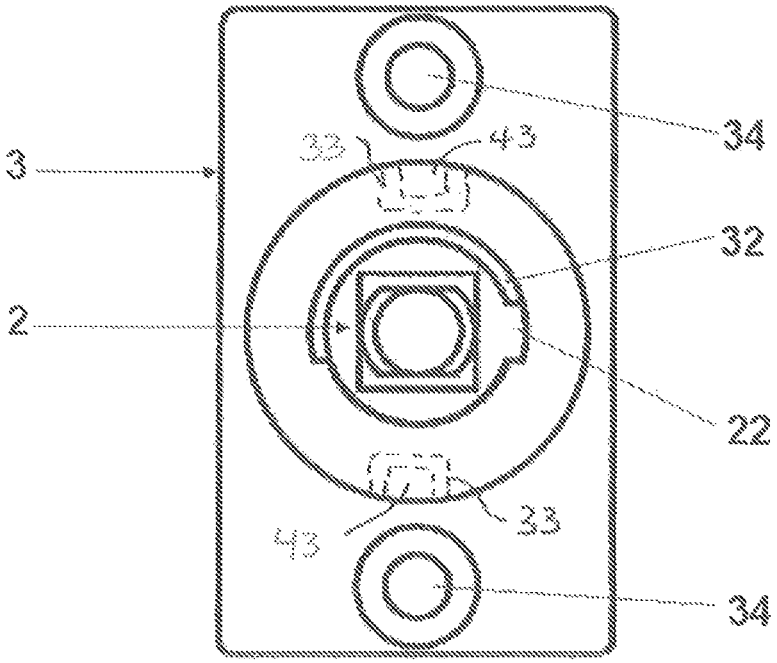
FIG. 5 represents a frontal view corresponding to FIG. 1, without the closure tongue (1) to view the cams (22), (32).

Described below is an example of practical, non-limiting embodiment of the present invention. Other forms of embodiment in which accessory changes that do not alter its basic principle are in no way disregarded; on the contrary, the present invention encompasses all its variations.

The present invention involves a new lockable knob lock, comprised basically of a closure tongue (1), a cylinder (2), a casing (3) and a knob (4) as well as a commercial lock.

According to the invention, and according to the embodiment represented, the casing (3) is a single-piece structure with at least a primary linear guide (33) and a primary circumferential cam (32), in addition to the known means/openings (34) to be mounted at the place of operation.

According to the invention, and according to the embodiment represented, the cylinder (2 is a single-piece structure with a second circumferential cam (22) formed in its head (23) and a body (21) of extra-flat configuration with an axially slotted opening (210) in its central zone and a primary radial opening (20) in its back zone.

The closure tongue is placed in the front of said cylinder (2). The structure, function and placement of this closure tongue (1) in the cylinder (2) are known; therefore, it is not described in further detail.

According to the invention, and according to the embodiment represented, the knob (4) is a single-pieced structure, with a body of revolution (41) with an outer second liner guide (43) and radial housing (410) inside; with an ergonomic head (42) presenting a second radial opening (40).

The assembly between the knob (4) and the cylinder (2) allowing relative linear movement between them takes place by placing, fastened on the body (41) of the knob, (4) a shaft-pin (5) that passes through the axially slotted opening (210) made in the body of the cylinder (2).

The locking and operation positions of the knob (4) on the casing (3) are achieved by linear movement of the knob (3) with respect to the casing (3), respectively, the linear guides (33) (43) being engaged between them.

The invention can be defined as follows

1.—A look comprising a lockable knob, structured in a closure tongue (1) non-rotatably mounted on the shaft of a cylinder (2) that rotates in a casing (3) when a knob (4) joined to it does so and characterized in that.

(a) the knob (4) is mounted on the cylinder (2) and casing (3) with the possibility of being moved linearly, guided between two end positions of operation and locking.

(b) the casing (3) and the knob (4) have at least two geometrically arranged linear guides (33), (43) that, in the linear movement of the knob (4), are engaged with or are released from each other;

(c) the cylinder (2) and the knob (4) each have radial openings (20), (40) that are coaxial—to lock between them the knob (4) and cylinder (2) in locking position—or axially offset—to allow the operation of the lock;

(d) the cylinder (2) and the casing (3) each have geometrically arranged cams (22), (32) that limit the rotational movement of the cylinder (2) on the casing (3) between the opening and closing positions of the tongue (1).

2.—A lock comprising a lockable knob, according to 1 above, characterized in that, to limit the path of said guided linear movement of the knob (4):

the body (21) of the cylinder (2) presents extra-flat configuration, with an axially slotted orifice (210);

the body (41) of the knob (4) presents radial housing (410) in which said body (21) of the cylinder (2) is housed jointly; and there is a shaft-pin (5) fastened to the body of the knob (4) and housed in the axially slotted orifice (210).

The invention claimed is:

1. A lock comprising a casing;

a cylinder rotatably mounted in the casing;

a closure tongue non-rotatably mounted on one end of the cylinder;

a knob mounted within the casing and on an other end of the cylinder, the knob linearly movable on the cylinder between two end positions, one end position being an unlocked position and an other end position being a locked position;

the knob having a linear guide and the casing having a linear guide, the linear guide of the knob and the linear guide of the casing being geometrically arranged such that the linear guide of the casing engages the linear guide of the knob in the locked position and the linear guide of the casing is released from the linear guide of the knob in the unlocked position;

the knob having a radial opening and the cylinder having a radial opening at the other end of the cylinder, the radial opening of the knob concentric with the radial opening of the cylinder in the locked position and the radial opening of the knob is offset from the radial opening of the cylinder in the unlocked position; and the cylinder having a cam and the casing having a cam, the cam of the cylinder and the cam of the casing being geometrically arranged such that the cam of the casing limit the rotation of the cylinder within the casing between the locked position and the unlocked position.

2. The lock of claim 1, wherein the cylinder has a flat body and the flat body has an axial slotted orifice;

the knob has a radial body with an axial slot in which the flat body of the cylinder is housed; and a shaft pin is fastened to the radial body of the knob and is housed in the axial slotted orifice of the cylinder.

* * * * *